US006893229B2

(12) United States Patent
Choi et al.

(10) Patent No.: US 6,893,229 B2
(45) Date of Patent: May 17, 2005

(54) VACUUM PREVENTING DEVICE OF SCROLL COMPRESSOR

(75) Inventors: Song Choi, Seoul (KR); Sog-Kie Hong, Seoul (KR); Dong-Won Yoo, Seoul (KR); In-Hwe Koo, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/732,452

(22) Filed: Dec. 11, 2003

(65) Prior Publication Data

US 2004/0126259 A1 Jul. 1, 2004

(30) Foreign Application Priority Data

Dec. 13, 2002 (KR) ..... 10-2002-0079831

(51) Int. Cl.[7] ..... F04B 49/00

(52) U.S. Cl. ..... 417/310; 418/55.1; 418/55.5; 418/57; 417/308

(58) Field of Search ..... 418/55.1, 55.5, 418/57; 417/308, 310

(56) References Cited

U.S. PATENT DOCUMENTS 5,090,880 A * 2/1992 Mashimo ..... 417/310
5,236,316 A * 8/1993 Iio ..... 417/310
5,240,388 A * 8/1993 Matsumoto et al. ..... 417/310
6,685,441 B2 * 2/2004 Nam ..... 417/310

FOREIGN PATENT DOCUMENTS

JP 58220988 A * 12/1983 ..... F04C/18/02
JP 2000-356194 A 12/2000

* cited by examiner

*Primary Examiner*—Theresa Trieu
(74) *Attorney, Agent, or Firm*—Birch, Stewart, Kolasch & Birch, LLP

(57) ABSTRACT

Disclosed is a vacuum preventing device of a scroll compressor comprising: a discharge cover installed at a body of a fixed scroll for dividing inside of a case into a discharge region and a suction region; a vacuum cylinder installed in the discharge cover thus to be connected to a compression chamber formed between the fixed scroll and an orbiting scroll and having a pressure space therein so that the discharge region can be connected to the suction region; a piston movably installed in the pressure space for selectively connecting the discharge region with the suction region by a pressure difference between the compression chamber and the suction region; and an elastic member installed in the pressure space for providing an elastic force to the piston.

13 Claims, 5 Drawing Sheets

VACUUM PREVENTING DEVICE OF SCROLL COMPRESSOR

This Nonprovisional application claims priority under 35 U.S.C. § 119 (a) on patent application Ser. No. 10-2002-0079831 filed in KOREA on Dec. 13, 2002, the entire contents of which are hereby incorporated by reference.

BACKGROUND OF THE INVENTION

1. Field of the Invention

The present invention relates to a vacuum preventing device of a scroll compressor, and more particularly, to a vacuum preventing device of a scroll compressor capable of preventing vacuum in a compressor by flowing backward discharge gas of a discharge region into a suction region at the time of abnormal driving such as pump down or expansion valve blocking.

2. Description of the Conventional Art

Generally, a compressor is a device for converting mechanical energy into latent energy of a compression fluid, and is largely classified into a reciprocation compressor, a scroll compressor, a centrifugal compressor, and a vane compressor by compression methods.

The scroll compressor has a structure that gas is sucked, compressed, and discharged by using a rotation member like the centrifugal type and the vane type differently from the reciprocating type which uses a linear reciprocation of an piston.

FIG. 1 is a longitudinal section view showing an inner part of a scroll compressor in accordance with the conventional art.

As shown, the conventional scroll compressor comprises: a case 1 having a gas suction pipe SP and a gas discharge pipe DP; a main frame 2 and a sub frame (not shown) respectively installed at upper and lower portions of an inner circumference surface of the case 1; a driving motor 3 installed between the main frame 2 and the sub frame; a rotation shaft 4 engaged to a center portion of the driving motor 3 for transmitting a rotation force of the driving motor 3; an orbiting scroll 5 installed to have an eccentric rotation at an upper portion of the rotation shaft 4 and having a wrap 5*a* of an involute curve shape at the upper portion thereof; and a fixed scroll 6 fixed to an upper portion of the main frame 2, engaged to the orbiting scroll 5, and having a wrap 6*a* of an involute curve shape so as to form a plurality of compression spaces P therein.

The case 1 is divided into a suction region S1 and a discharge region S2 by a high and low pressure separation plate 7.

A gas inlet 6*b* and a gas outlet 6*c* are respectively formed at a lateral surface and a center portion of the fixed scroll 6, and a non-return valve 8 for preventing discharged gas from flowing backward is installed at an upper surface of the fixed scroll 6.

The main frame 2 and the sub frame are fixed to the inner circumference surface of the case 1 by a fixation means such as welding, and the fixed scroll 6 is also fixed to a lower surface of the high and low pressure separation plate 7 by a fixation means such as a bolt.

Meantime, in case of a pump down and an expansion valve blocking, the suction region S1 of the compressor becomes a high vacuum state. At this time, components of the compressor may be damaged and destroyed.

To prevent this, in the conventional art, a vacuum preventing device 9 is provided in the body 6A of the fixed scroll 6.

FIG. 2 is a longitudinal section view showing an operation of the conventional vacuum preventing device at the time of a normal driving, and FIG. 3 is a longitudinal section view showing an operation of the conventional vacuum preventing device at the time of an abnormal driving.

Referring to FIGS. 2 and 3, the conventional vacuum preventing device 9 comprises a pressure space 10 formed in the fixed scroll 6, and a discharge flow path 11 connected to the discharge region S2 at an upper surface of the pressure space 10.

A compression flow path 12 connected to a compression chamber is formed at a lower surface of the pressure space 10, a plug 14 having a suction flow path 13 is fixed to an opening portion of the pressure space 10 by a fixation pin 15, and the suction flow path 13 is connected to the discharge flow path 11.

A piston 17 for selectively connecting the discharge flow path 11 and the suction flow path 13 is movably installed in the pressure space 10.

A spring 16 for limiting a movement of the piston 17 and providing an elasticity force thereto is installed at the opening portion of the pressure space 10.

Hereinafter, operations of the conventional scroll compressor will be explained.

First, when a power source is applied to the driving motor 3, the driving motor 3 rotates the rotation shaft 4, and the orbiting scroll 5 engaged to the rotation shaft 4 is rotated to an extent of its eccentric distance.

At this time, the plurality of compression spaces P formed between the wrap 5*a* of the orbiting scroll 5 and the wrap 6*a* of the fixed scroll 6 gradually move towards a center portion of the fixed scroll 6 as the orbiting scroll 5 continuously performs an orbiting movement, thereby decreasing in volume.

By the decreased volume of the compression spaces P, gas of the suction region S1 is sucked into the compression spaces P through the inlet 6*b*, and the sucked gas is discharged to the discharge region S2 through the gas outlet 6*c*.

When the compressor is normally driven, a pressure of the compression chamber is larger than an elasticity force of the spring 16, so that the piston 17 overcomes the elasticity force of the spring 16 and blocks the discharge flow path 11.

However, when the compressor is abnormally driven due to a pump down or an expansion valve blocking, inside of the compression chamber becomes vacuum and a pressure of the compression chamber P becomes smaller than the elasticity force of the spring 16, so that the piston 17 is shoved by the elasticity force of the spring 16 and opens the discharge flow path 11. At this time, the discharge flow path 11 is connected to the suction flow path 13.

As the discharge flow path 11 and the suction flow path 13 are connected to each other, gas of the discharge region S2 flows backward into the suction region S1 through the discharge flow path 11 and the suction flow path 13, thereby releasing the vacuum in the compressor.

However, in the conventional art, since the vacuum preventing device is formed in the fixed scroll, a fabrication cost of the vacuum preventing device is too expensive and an intensity of the fixed scroll is degraded. According to this, the fixed scroll is easily damaged during operation.

Also, since the pressure space is formed at the lateral surface of the fixed scroll and the plug has to be inserted to an end of the opening portion of the pressure space in order to prevent the spring and the piston installed in the pressure space from being separated, an entire construction becomes complicated and a fabrication cost is increased.

SUMMARY OF THE INVENTION

Therefore, an object of the present invention is to provide a vacuum preventing device of a scroll compressor which can prevent damage of a fixed scroll by enhancing an intensity of the fixed scroll and reduce a fabrication cost of the fixed scroll by installing the vacuum preventing device outside the fixed scroll.

Another object of the present invention is to provide a vacuum preventing device of a scroll compressor in which a pressure space is formed at a lower portion of a vacuum cylinder adjacent to the fixed scroll, and a plug for preventing a spring and a piston installed in the pressure space from being separated is not required, thus the fixed scroll plays a role of the plug, thereby reducing the number of construction components and reducing a fabrication cost.

To achieve these and other advantages and in accordance with the purpose of the present invention, as embodied and broadly described herein, there is provided a vacuum preventing device of a scroll compressor comprising: a discharge cover installed at a body of a fixed scroll for dividing inside of a case into a discharge region and a suction region; a vacuum cylinder installed in the discharge cover thus to be connected to a compression chamber formed between the fixed scroll and an orbiting scroll and having a pressure space therein so that the discharge region can be connected to the suction region; a piston movably installed in the pressure space for selectively connecting the discharge region with the suction region by a pressure difference between the compression chamber and the suction region; and an elastic member installed in the pressure space for providing an elastic force to the piston.

A suction flow path for connecting the suction region with the pressure space is formed at an upper portion of the vacuum cylinder, a discharge flow path for connecting the discharge region with the pressure space is formed at a lateral surface of the vacuum cylinder, and a compression flow path for connecting the compression chamber with the pressure space is formed at the body of the fixed scroll.

Diameters of the suction flow path, the discharge flow path, and the compression flow path are formed to be shorter than a diameter of the pressure space.

The vacuum cylinder is extended from an inner upper surface of the discharge cover to an upper surface of the body of the fixed scroll as a unit with the discharge cover.

One end of the elastic member is fixed to an upper portion of the pressure space, and another end thereof is fixed to a spring fixing protrusion formed at an upper portion of the piston.

The pressure space is formed with a predetermined depth from a lower surface of the vacuum cylinder to an upper surface thereof, and an inner diameter of the pressure space is formed equally from the upper portion thereof to the lower portion thereof.

A sealing member is installed at contact surfaces between the body of the fixed scroll and the discharge cover, and between the body of the fixed scroll and the vacuum cylinder.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 4:
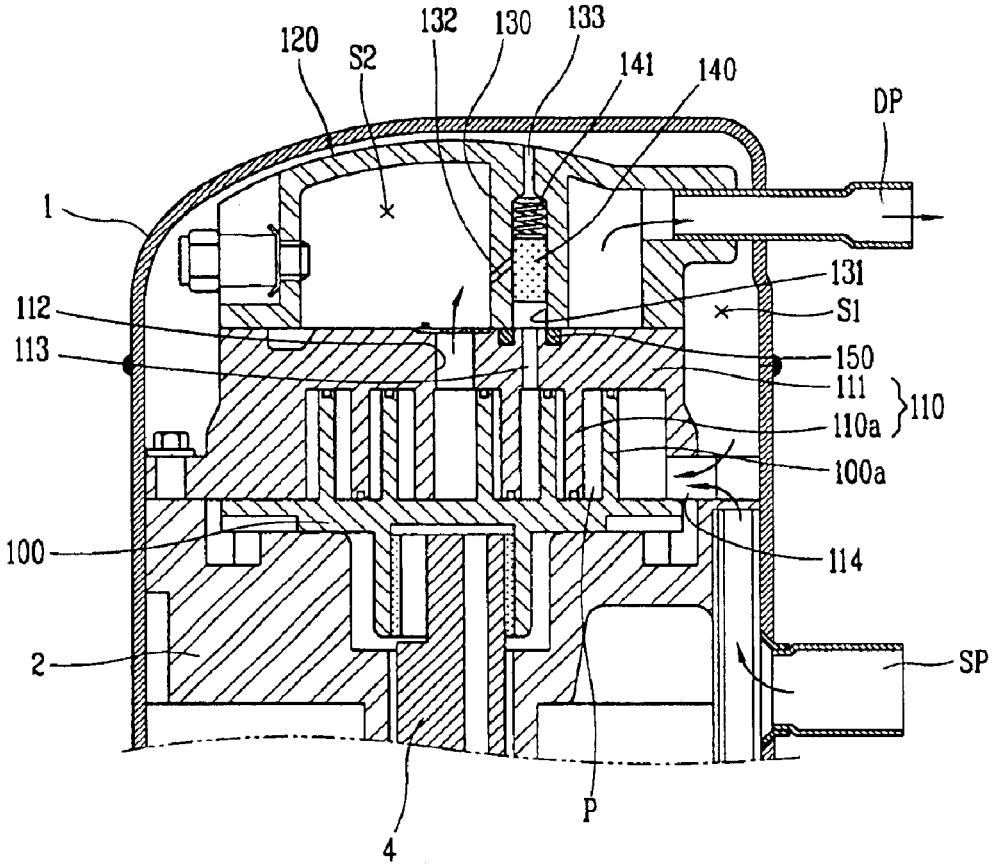
FIG. 4 is a longitudinal section view showing a scroll compressor according to the present invention.
Figure 5:
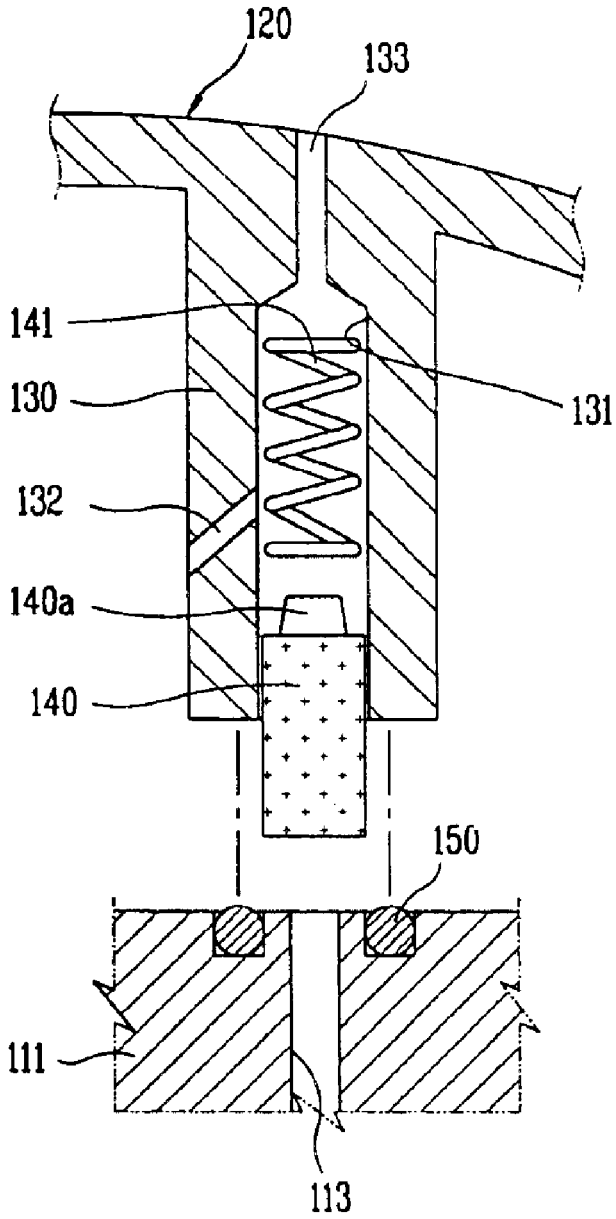
FIG. 5 is a disassembled longitudinal section view showing a vacuum preventing device according to the present invention.
Figure 6:
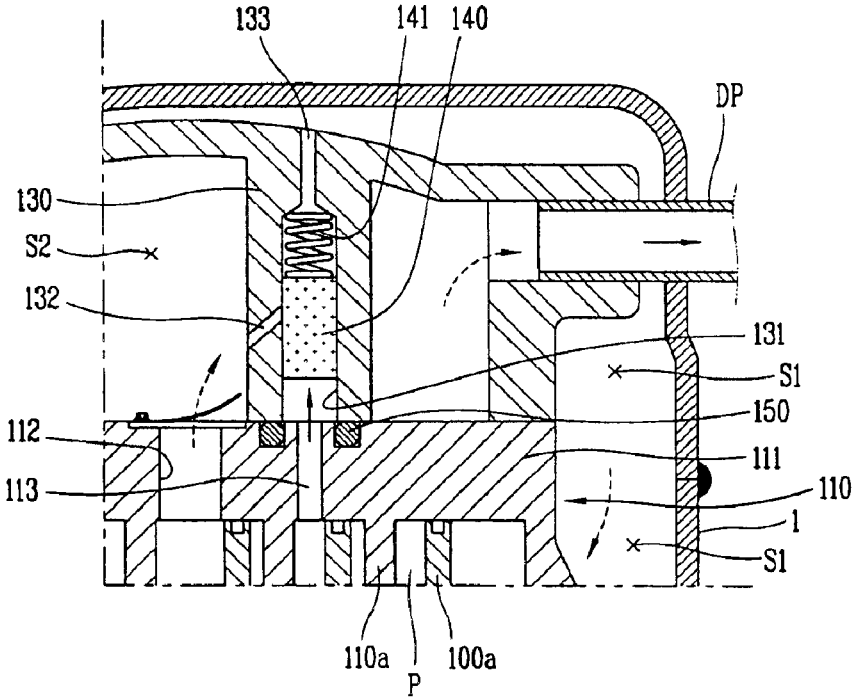
FIG. 6 is a longitudinal section view showing an operation of the vacuum preventing device when the scroll compressor of the present invention is normally driven.
Figure 7:
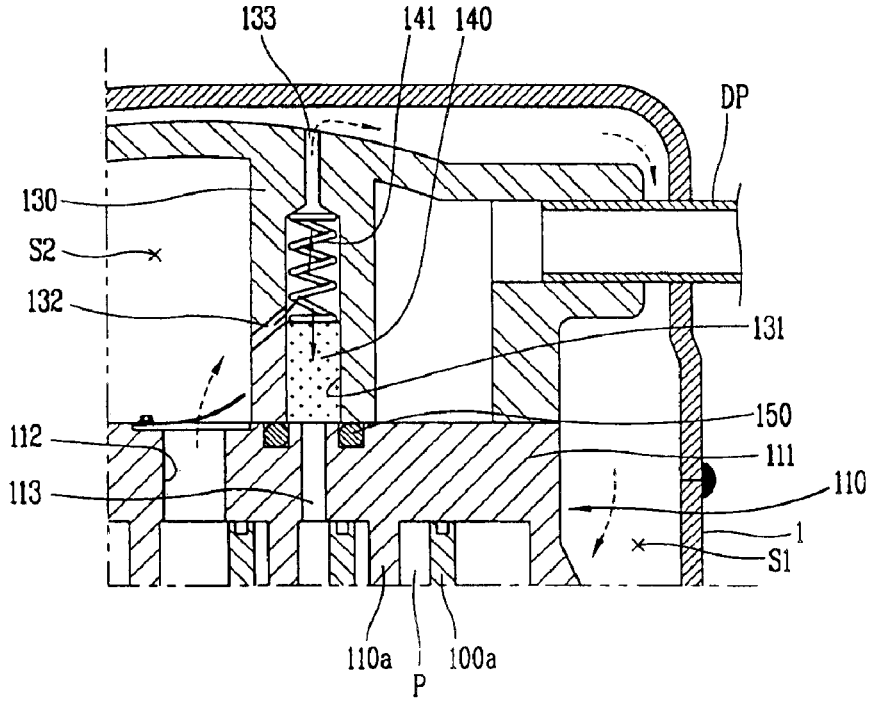
FIG. 7 is a longitudinal section view showing an operation of the vacuum preventing device when the scroll compressor of the present invention is abnormally driven

FIG. 4 is a longitudinal section view showing a scroll compressor according to the present invention, FIG. 5 is a disassembled longitudinal section view showing a vacuum preventing device according to the present invention, FIG. 6 is a longitudinal section view showing an operation of the vacuum preventing device when the scroll compressor of the present invention is normally driven, and FIG. 7 is a longitudinal section view showing an operation of the vacuum preventing device when the scroll compressor of the present invention is abnormally driven.

In a vacuum preventing device according to the present invention, a discharge cover 120 is installed at a body 111 of a fixed scroll 110, a vacuum cylinder 130 having a pressure space 131 is installed at the discharge cover 120, and a piston 140 which moves by an elastic force of a spring 141 according to a pressure difference between the compression chamber and the suction region is installed in the pressure space 131.

The fixed scroll 110 is composed of the body 111 and a wrap 110*a* formed at the lower portion of the body 111 with an involute shape. A discharge hole 112 connected to a compression chamber P and a discharge region S2 of the discharge cover 120 is formed at a center of the body 111.

A compression flow path 113 connected to the compression chamber P is formed at one side of the body 111 of the fixed scroll, and refrigerant gas inlet 114 is formed at another side of the body 111.

As aforementioned, the discharge cover 120 connected to a gas discharge pipe DP is installed at the upper surface of the body 111 of the fixed scroll 110 to cover the body 111. Also, the discharge cover 120 divides its inside and outside into a suction region S1 and a discharge region S2, respectively.

A structure of the discharge cover 120 will be explained in detail.

The discharge cover 120 is hermetically engaged to the upper surface of the fixed scroll 110, and the vacuum cylinder 130 of a pillar shape is protruded towards a longitudinal direction in the discharge cover 120 and thus extended to the upper surface of the body 111.

It is preferable that the vacuum cylinder 130 is formed of the same material with the discharge cover 120 for intensity.

The vacuum cylinder 130 can be formed with a tube shape so that the inner circumference surface and the outer circumference surface can have the pressure space of a circle shape or a polygon shape.

In the present invention, the pressure space 131 is formed with a predetermined depth from the lower surface of the vacuum cylinder 130 to the upper surface thereof, and an inner diameter of the pressure space 131 is formed equally from the upper portion thereof to the lower portion thereof.

Figure 1:
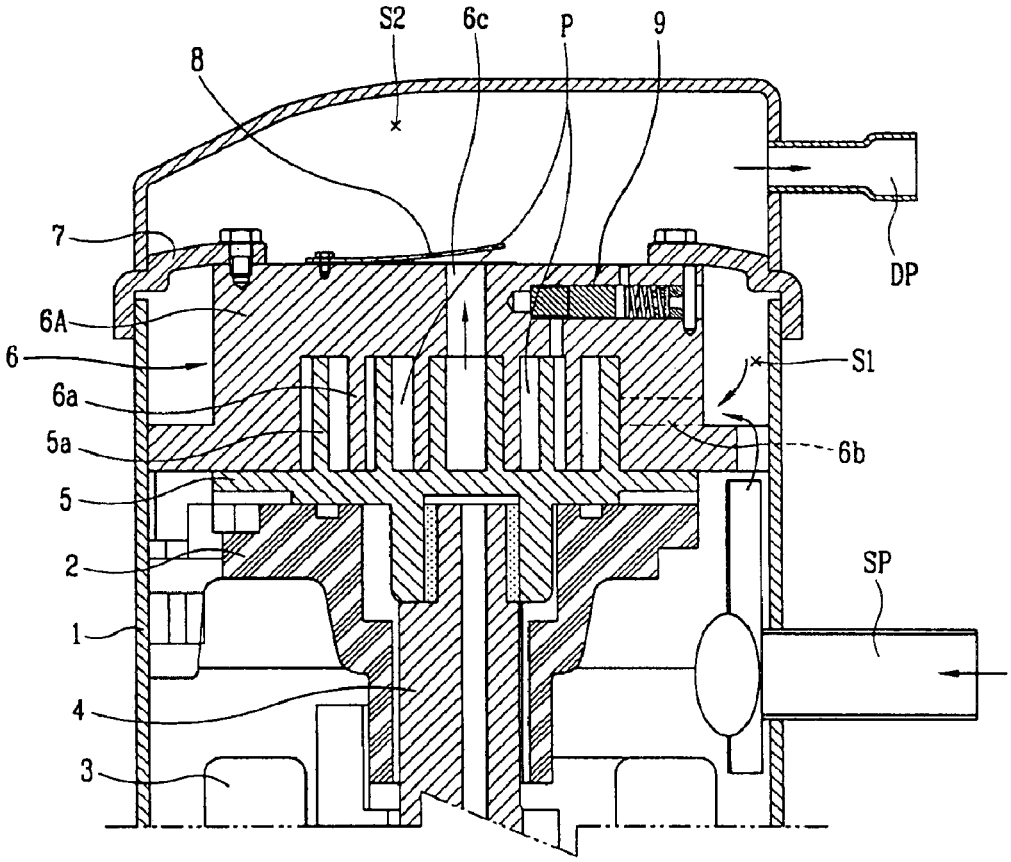
FIG. 1 CONVENTIONAL ART
FIG. 1 is a longitudinal section view showing a scroll compressor in accordance with the conventional art.
Figure 2:
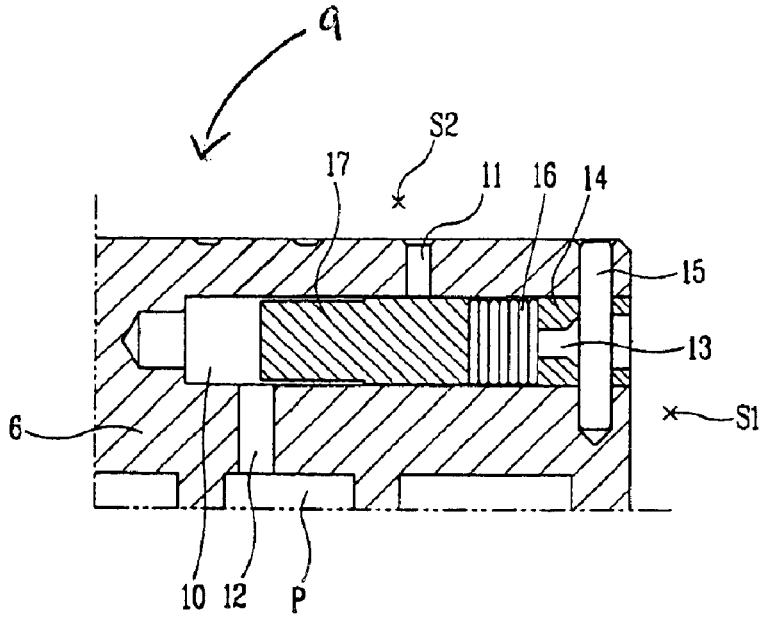
FIG. 2 CONVENTIONAL ART
FIG. 2 is a longitudinal section view showing an operation of a vacuum preventing device when the conventional scroll compressor is normally driven.
Figure 3:
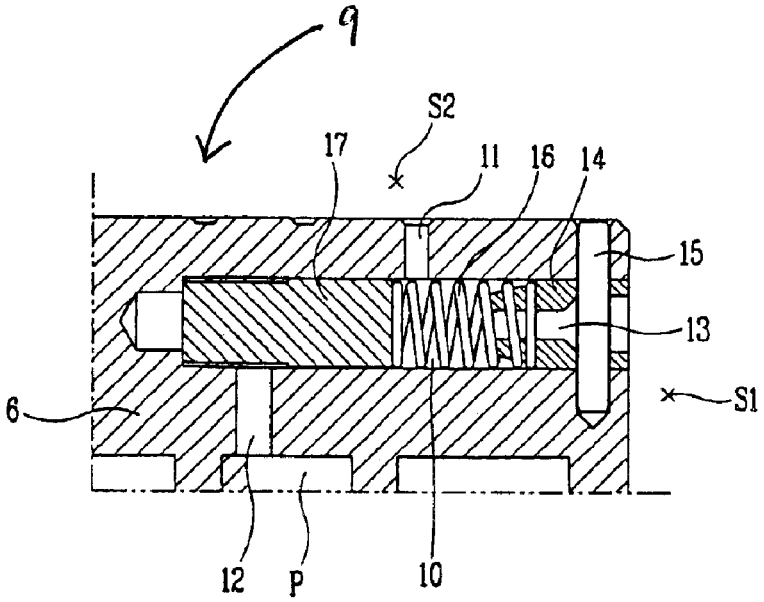
FIG. 3 CONVENTIONAL ART
FIG. 3 is a longitudinal section view showing an operation of the vacuum preventing device when the conventional scroll compressor is abnormally driven.

Although not shown, if the pressure space 131 is formed with a predetermined depth from the upper surface of the vacuum cylinder 130 to the lower surface, the spring 141 and the piston 140 have to be assembled in the pressure space 131 and the plug 14 (Referring to FIG. 2) has to be installed at the end of the opening portion of the pressure space 131 in order to prevent the spring 141 and the piston 140 from being separated from the pressure space 131. However, in the present invention, if the pressure space 131 is formed with a predetermined depth from the lower surface of the vacuum cylinder 130 to the upper surface thereof, the discharge cover 120 is assembled to the body 111 and the body 111 plays a role of the plug. According to this, the conventional plug 14 is not required in the present invention.

The lower portion of the pressure space 131 is positioned to cover the compression flow path 113 formed at the body 111 of the fixed scroll 110.

A discharge flow path 132 connected to the discharge region S2 in the discharge cover 110 is formed at a middle portion of the vacuum cylinder 130, and a suction flow path 133 connected to the suction region in the case 1 is formed at the upper portion of the vacuum cylinder 130.

In order to make the piston 140 be slid smoothly in the pressure space 131, the inner diameter of the pressure space 131 and an outer diameter of the piston 140 are properly set.

That is, if the inner diameter of the pressure space 131 is greater than the outer diameter of the piston 140 and thus a clearance (not shown) generated between the pressure space 131 and the inner circumference surface of the vacuum cylinder 130 becomes to large, compression gas can leak due to the clearance. Conversely, if the clearance is too small, the piston 140 cannot be operated smoothly. Therefore, the clearance should be properly set.

It is preferred that the discharge flow path 132 formed in a slant so that discharge gas of the discharge region S2 can be quickly exhausted to the suction region S1 when the operation of the compressor becomes abnormal. Also, the inside of the discharge flow path 132 is preferably located higher than the outside thereof.

It is preferable that a diameter of the suction flow path 133 is formed to be less than that of the pressure space 131.

The compression spring 141 installed in the pressure space 131 has an upper end fixed to the upper portion of the pressure space 131 and a lower end fixed to a spring fixing protrusion 140*a* formed at the upper surface of the piston 140.

A sealing member 150 such as O-ring is preferably installed at a contact surface between the lower end surface of the vacuum cylinder 130 and the body 111 of the fixed scroll 110.

The piston 140 is preferably formed of light-weight material such as engineering plastic so that the piston 140 can be smoothly moved up and down in the pressure space 131 and noise generated when the piston collides with the body 111 can be reduced.

The piston 140 can be formed as a circle shape or a polygon shape in accordance with a shape of the pressure space 131, and the spring fixing protrusion 140*a* for fixing the spring 141 is preferably formed at the upper surface of the piston 140.

Modulus of elasticity of the spring 141 should be properly set by considering a case of a normal driving of the compressor and a case of an abnormal driving. That is, when the compressor is normally driven, the piston 140 has to overcome elasticity of the spring 141 by a pressure applied through the compression flow path 113, move, and block the suction flow path 133 and the discharge flow path 132. Conversely, when the compressor is abnormally driven, the piston 140 has to connect the discharge flow path 132 and the suction flow path 133 by the elasticity of the spring 141.

Reference numeral 1 denotes a case, 2 denotes a main frame, 100 denotes an orbiting scroll, and 100*a* denotes a wrap of the orbiting scroll.

Operations of the scroll compressor according to the present invention will be explained.

First, when a power source is applied to the driving motor 3, the driving motor 3 rotates the rotation shaft 4, and an orbiting scroll engaged to the rotation shaft 4 is rotated to an extent of its eccentric distance.

At this time, the plurality of compression spaces P formed between a wrap 100*a* of the orbiting scroll 100 and the wrap 110*a* of the fixed scroll 110 gradually move towards a center portion of the fixed scroll 110 as the orbiting scroll 100 continuously performs an orbiting movement, decreasing in volume.

By the decreased volume of the compression spaces P, gas of the suction region S1 is sucked into the compression spaces P through the inlet 114, and the sucked gas is discharged to the discharge region S2 through the gas outlet 112.

When the compressor is normally driven, as shown in FIG. 6, gas of high pressure is introduced into the pressure space 131 of the vacuum cylinder 130 through the compression flow path 113, and the gas of high pressure overcomes low pressure of the suction side of the vacuum cylinder 130 and resistance of the spring 141. The gas of high pressure pushes up the piston 140 towards the suction flow path 133 and blocks the discharge flow path 132, thereby preventing a part of the discharge gas discharged to the discharge region S2 of the discharge cover 120 from flowing backward into the suction region S1 of the case 1 through the discharge flow path 132.

On the contrary, when the compressor is abnormally driven due to expansion valve blocking or pump down, as shown in FIG. 7, the spring 141 compressed in a state that a pressure of the suction region S1 and a pressure of the compression chamber P are almost equal expands and pushes the piston 140 towards the compression flow path 113. Herein, in a state that the discharge flow path 132 and the suction flow path 133 are connected to each other, a part of the discharge gas of high pressure is introduced to inside of the pressure space 131 of the vacuum cylinder 130 through the discharge flow path 132, and introduced into the suction region S1 of the case 1 through the suction flow path 133, then sucked into the compression chamber P as its pressure is lowered. According to this, over-compression or high-vacuum state of each compression chamber is prevented.

Then, if the compressor performs a normal driving again, compression gas of the compression chamber P is introduced into the pressure space 131 of the vacuum cylinder 130 through the compression flow path 113, and pushes up the piston 140, thereby blocking the discharge flow path 132 and the suction flow path 133.

As aforementioned, in the present invention, by constructing the vacuum preventing device at the discharge cover 120 which forms the discharge region S2, the fixed scroll 110 is easily processed thus to reduce a fabrication cost and to maintain an intensity of the fixed scroll 110, thereby enhancing a reliability of the compressor.

Also, by processing the discharge cover 110 with a simple method such as die casting, a processing cost can be reduced. Besides, the spring 141 and the piston 140 can be assembled in the pressure space 131 easily and conveniently without the plug used in the conventional art.

Also, by forming the vacuum piston with light-weight material, collision noise can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A vacuum preventing device of a scroll compressor comprising:

a discharge cover installed at a body of a fixed scroll for dividing inside of a case into a discharge region and a suction region, wherein a cavity created within the discharge cover forms the discharge region;

a vacuum cylinder installed in the discharge cover thus to be connected to a compression chamber formed between the fixed scroll and an orbiting scroll and having a pressure space therein so that the discharge region is connected to the suction region;

a piston movably installed in the pressure space for selectively connecting the discharge region with the suction region by a pressure difference between the compression chamber and the suction region; and an elastic member installed in the pressure space for providing an elastic force to the piston.

2. The device of claim 1, wherein a suction flow path for connecting the suction region with the pressure space is formed at an upper portion of the vacuum cylinder, a discharge flow path for connecting the discharge region with the pressure space is formed at a lateral surface of the vacuum cylinder, and a compression flow path for connecting the compression chamber with the pressure space is formed at the body of the fixed scroll.

3. The device of claim 2, wherein diameters of the suction flow path, the discharge flow path, and the compression flow path are formed to be less than a diameter of the pressure space.

4. The device of claim 2, wherein the discharge flow path is formed in a slant.

5. The device of claim 4, wherein an end of the discharge flow path connecting the pressure space is located higher than an end of the discharge flow path connecting the discharge region.

6. The device of claim 2, wherein a shape of the pressure space is a circle.

7. The device of claim 2, wherein a shape of the pressure space is a polygon.

8. The device of claim 1, wherein the vacuum cylinder is extended from an inner upper surface of the discharge cover to an upper surface of the body of the fixed scroll as a unit with the discharge cover.

9. The device of claim 1, wherein the elastic member is a compression spring.

10. The device of claim 1, wherein one end of the elastic member is fixed to an upper portion of the pressure space, and another end thereof is fixed to a spring fixing protrusion formed at an upper portion of the piston.

11. The device of claim 1, wherein the pressure space is formed with a predetermined depth from a lower surface of the vacuum cylinder to an upper surface thereof, and an inner diameter of the pressure space is formed equally from an upper portion thereof to a lower portion thereof.

12. The device of claim 1, wherein a sealing member is installed at contact surfaces between the body of the fixed scroll and the discharge cover and the body of the fixed scroll and the vacuum cylinder.

13. The device of claim 12, wherein the sealing member is an O-ring.

* * * * *